US008805263B2

(12) United States Patent
Kim

(10) Patent No.: US 8,805,263 B2
(45) Date of Patent: Aug. 12, 2014

(54) DEVELOPING UNIT CLEANING BLADE AND IMAGE FORMING APPARATUS HAVING THE SAME

(75) Inventor: Young-chae Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 186 days.

(21) Appl. No.: 13/241,422

(22) Filed: Sep. 23, 2011

(65) Prior Publication Data

US 2012/0237277 A1 Sep. 20, 2012

(51) Int. Cl.
*G03G 21/00* (2006.01)

(52) U.S. Cl.
USPC ..... 399/350

(58) Field of Classification Search
CPC ..... G03G 15/161; G03G 21/0005; G03G 21/0011; G03G 2215/1604; G03G 2215/1657; G03G 2215/1661
USPC ..... 399/350, 351, 347, 349, 99, 123, 186
See application file for complete search history.

(56) References Cited

U.S. PATENT DOCUMENTS

| | | | | |
|---|---|---|---|---|
| 5,671,468 | A * | 9/1997 | Yamamoto et al. | 399/169 |
| 2001/0024580 | A1 * | 9/2001 | Kusunose | 399/111 |
| 2006/0188288 | A1 * | 8/2006 | Tomiie et al. | 399/128 |
| 2006/0216085 | A1 * | 9/2006 | Murakami et al. | 399/350 |

FOREIGN PATENT DOCUMENTS

| | | | | |
|---|---|---|---|---|
| JP | 07175394 | A * | 7/1995 | G03G 21/10 |
| JP | 08272270 | A * | 10/1996 | G03G 21/08 |

* cited by examiner

*Primary Examiner* — Billy Lactaoen
(74) *Attorney, Agent, or Firm* — Stanzione & Kim, LLP

(57) ABSTRACT

A developing unit and an image forming apparatus are disclosed. The developing unit includes an image carrier on which an electrostatic latent image is formed, a developing member to supply a developer to the image carrier, and a first cleaning member having a first cleaning blade to remove a non-transferred developer on the image carrier. The first cleaning blade is configured to be reversible between a counter disposition, which is opposite to a rotation direction of the image carrier while the image carrier is in a printing operation, and a trailing disposition, which corresponds to the rotation direction.

18 Claims, 4 Drawing Sheets

DEVELOPING UNIT CLEANING BLADE AND IMAGE FORMING APPARATUS HAVING THE SAME

CROSS-REFERENCE TO RELATED APPLICATIONS

This application claims priority of Korean Patent Application No. 10-2011-0023853, filed Mar. 17, 2011, in the Korean Intellectual Property Office, the disclosure of which is incorporated herein by reference in its entirety.

BACKGROUND OF THE INVENTION

1. Field of the Invention

Apparatuses and methods consistent with the present general inventive concept relate to a developing unit and an image forming apparatus having the same. More particularly, the present general inventive concept relates to a developing unit having at least one cleaning blade and an image forming apparatus having the same.

2. Description of the Related Art

An image forming apparatus, such as a copier, a printer, and a multifunction machine to realize functions of these devices as a single device, is an apparatus, which forms a desired image on a printing medium by using an electrophotography.

In general, the image forming apparatus includes an image carrier (for example, a photoconductive drum). In a printing work, an electrostatic latent image formed on the image carrier is developed into a developer image by a developing member, and the developer image is transferred onto the printing medium directly or through a transfer belt.

To remove a non-transferred developer existing on the image carrier, the image forming apparatus is generally provided with a single cleaning blade or a plurality of cleaning blades. By bringing an end of the cleaning blade in contact with or to a surface of the rotating image carrier, the non-transferred developer can be separated from the image carrier. Like this, since the cleaning blade is maintained in a contact state with the image carrier, the cleaning blade may be deformed by a contact pressure applied from the image carrier, and this deformation may be a cause of reducing a cleaning performance of the cleaning blade.

On the other hand, the image forming apparatus is provided with a charging member to form a given potential on the surface of the image carrier when forming the electrostatic latent image thereon, and a discharging or electricity removing member to remove the potential remaining on the surface of the image carrier after the printing work. The electricity removing member emits a light on the image carrier through a space between the cleaning blade and the charging member, thereby removing the potential on the image carrier.

If the image forming apparatus is provided with the plurality of cleaning blades or is designed to be miniaturized, the space between the cleaning blade and the charging member is limited, thereby lowering an electricity removing performance of the electricity removing member. In an effort to solve this problem, a method may be used to increase the number of light sources (for example, light emitting diodes (LEDs)) to be included in the electricity removing member. However, such a method may cause an increase in manufacturing costs of the image forming apparatus.

SUMMARY OF THE INVENTION

The present general inventive concept provides an imager forming apparatus to minimize a deformation of a cleaning blade. Also, the present general inventive concept provides an image forming apparatus and method to enhance an electricity removing performance while decreasing manufacturing costs thereof.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing a developing unit including an image carrier on which an electrostatic latent image is formed, a developing member to supply a developer to the image carrier, and a first cleaning member having a first cleaning blade to remove a non-transferred developer on the image carrier, wherein the first cleaning blade is configured to be reversible between a counter disposition, which runs counter to a rotation direction of the image carrier while the image carrier is working, and a trailing disposition, which follows the rotation direction.

The first cleaning blade may be set to have the counter disposition in fabrication, and reversed to the trailing disposition when the developing unit is used for the first time.

The first cleaning blade may be reversed from the trailing disposition to the counter disposition when a printing work is finished. The first cleaning blade may also be reversed from the counter disposition to the trailing disposition when the printing work is started.

The reversion between the counter disposition and the trailing disposition may be conducted by a friction force of the image carrier applied to the first cleaning blade from the image carrier when the image carrier rotates.

The first cleaning blade may include a first contact edge to come in contact with the image carrier in the counter disposition and a second contact edge to come in contact with the image carrier in the trailing disposition.

The unit may further include a second cleaning blade for removing the non-transferred developer on the image carrier.

The non-transferred developer on the image carrier may be first removed by the second cleaning blade and secondly removed by the first cleaning blade.

The first cleaning blade may include an elastic material.

The first cleaning blade may include a urethane material.

The developer may be a spherical toner.

The first cleaning member may further include a first bracket to support the first cleaning blade.

The unit may further include a charging member to charge a surface of the image carrier with electricity, and an electricity removing member to emit a light to the image carrier thus to remove an potential on the surface of the image carrier, and the first bracket at a side surface thereof may include a reflection material for reflecting at least a portion of the light emitted from the electricity removing member toward the surface of the image carrier.

The reflection material may be plated on the side surface of the first bracket.

A reflection plate including the reflection material may be attached to the side surface of the first bracket.

The reflection material may be a nickel or silver.

The side surface of the first bracket may include two planes inclined to each other.

The foregoing and/or other aspects and utilities of the present general inventive concept may also be achieved by providing a developing unit usable with an image forming apparatus, the developing unit having an image carrier on which an electrostatic latent image is formed, a charging member to charge a surface of the image carrier with electricity, a developing member to supply a developer to the image carrier, a cleaning member having a cleaning blade for removing a non-transferred developer on the image carrier and a bracket for supporting the cleaning blade, and an electricity removing member to emit a light to the image carrier thus to remove an potential on the surface of the image carrier, wherein the bracket at a side surface thereof comprises a reflection material for reflecting at least a portion of the light emitted from the electricity removing member toward the surface of the image carrier.

The electricity removing member may emit the light through a space between the cleaning member and the charging member toward the surface of the image carrier.

The side surface of the bracket may include two planes inclined to each other.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
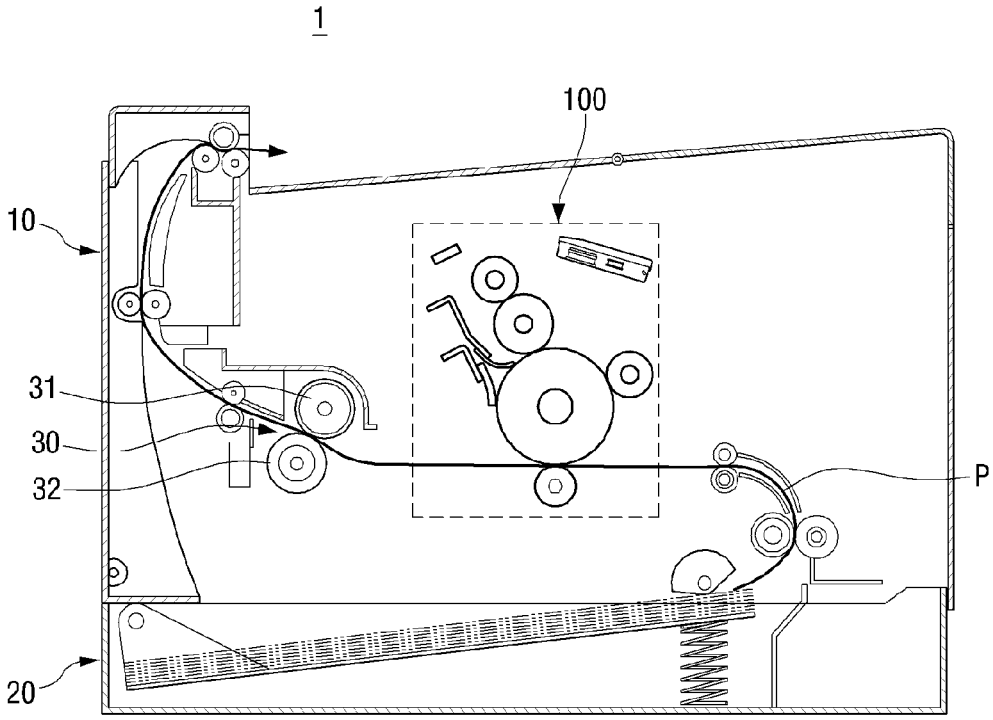
FIG. 1 is a view schematically illustrating an image forming apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a view schematically illustrating an image forming apparatus according to an exemplary embodiment of the present general inventive concept.

Referring to FIG. 1, the image forming apparatus 1 includes a main body 10, and a printing medium supplying unit 20 coupled to a lower end of the main body 10. In the main body 10 are contained internal parts, such as a developing unit (or image forming unit) 100, a fixing unit 30, etc.

The developing unit 100 forms a visual image on a printing medium conveyed from the printing medium supplying unit 20, and the fixing unit 30 applies heat and pressure to the printing medium through a heating roller 31 and a pressing roller 32 thus to fix the image on the printing medium. A printing process is performed on a printing medium fed along a printing medium conveying path P. The printing medium is picked-up from the printing medium supplying unit 20 to receive a developer image from an image carrier 110 (see FIG. 2) while passing through between the image carrier 110 and a transfer member 150 (see FIG. 2) in the developing unit 100. An image fixing procedure is performed on the printing medium by the fixing unit 30 to fix the developer image, and then the printing medium is discharged out of the main body 10.

Although FIG. 1 illustrates the image forming apparatus 1 as a printer adapted to print a mono color image. However, the present general inventive concept is not limited thereto. It is possible that the present general inventive concept may not only be applied to multi-pass or single-pass type color printers, but also to other type image forming apparatuses, such as a facsimile, a copier, a multifunction printer, etc., in the same principle and manner.

Figure 2:
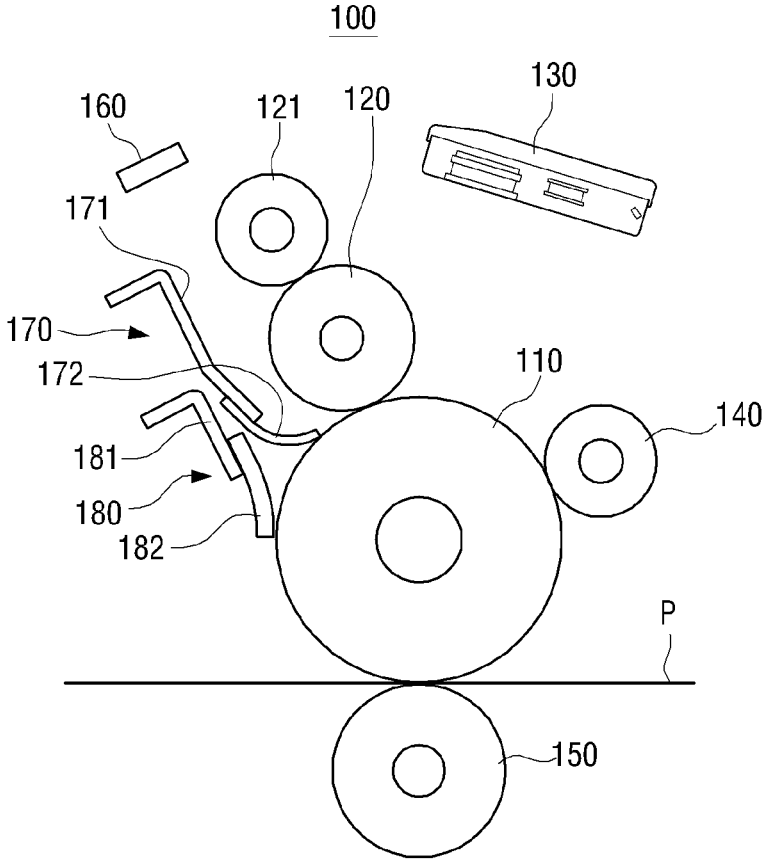
FIG. 2 is a schematic view illustrating a developing unit of the image forming apparatus of FIG. 1.

FIG. 2 is a schematic view illustrating the developing unit 100 of the image forming apparatus of FIG. 1.

Referring to FIG. 2, the developing unit 100 includes an image carrier 110, a charging member 120, an exposing member 130, a developing member 140, a transfer member 150, and an electricity removing member 160.

An electrostatic latent image may be formed on the image carrier 110 by the charging member 120 and the exposing member 130. The electrostatic latent image formed on the image carrier 110 is developed into a developer image by a developer provided from the developing member 140, and the developer image is transferred onto the printing medium passing between the image carrier 110 and the transfer member 150.

The charging member 120 is provided as a charging roller to be in direct contact with the image carrier 110. A surface of the image carrier 110 is charged with electricity by the charging member 120 to have a given potential before forming the electrostatic latent image thereon. A cleaning roller 121 is disposed to come in direct contact with a surface of the charging member 120, and thus contaminants on the surface of the charging member 120 may be removed by the cleaning roller 121.

The exposing member 130 emits a light on the surface of the image carrier 110 charged with electricity by the charging member 120 such that the electrostatic latent image is formed thereon. In the exemplary embodiment, the exposing member 130 may be provided as a laser scanning unit.

The developing member 140 provides the developer on the surface of the image carrier 110 thus to change the electrostatic latent image on the surface of the image carrier 110 into a developer image. In the exemplary embodiment, the developing member 140 is provided as a developing roller, which is disposed to come in direct contact with the image carrier 110. Although there is not illustrated in FIG. 2, a developer supplying member (for example, a developing roller), which supplies the developer contained in a developer storing space (developer storing container or developer supplying unit) to the developing member 140, may be provided on the rear side of the developing member 140.

The transfer member 150 transfers the developer image formed on the image carrier 110 onto the printing medium. In the exemplary embodiment, the transfer member 150 is provided as a transfer roller, which is disposed to come in direct contact with the image carrier 110 through the printing medium.

In the exemplary embodiment, the developer image formed on the image carrier 110 is directly transferred onto the printing medium by the transfer member 150. In an alternative exemplary embodiment, the developer image on the image carrier 110 may be first transferred onto an intermediate transfer belt, which is disposed to come in direct contact with the image carrier 110, and then onto the printing medium passing between the intermediate transfer belt and a transfer roller (a secondary transfer roller).

After the developer image is transferred onto the printing medium, the electricity removing member 160 removes the potential remaining on the image carrier 110. The electricity removing member 160 may include, for example, one or a plurality of LEDs, to emit LED light to remove the potential on the image carrier 110.

Referring again to FIG. 2, the developing unit 100 may include one or more cleaning members, for example, a first cleaning member 170 and a second cleaning member 180.

The first and the second cleaning members 170 and 180 are coupled to the main body 10 to remove a non-transferred developer remaining on the image carrier 110 after the transfer of the developer image as described above. The image carrier 110 illustrated in FIG. 2 rotates clockwise in a printing operation to form an electrostatic latent image, receive a developer to develop the electrostatic latent image with the developer, and then transfer the developer image to the printing medium. Accordingly, the non-transferred developer on the image carrier 110 is first removed by the second cleaning member 180 and is secondly removed by the first cleaning member 170.

Thus, a portion of the non-transferred developer is removed by the second cleaning member 180, and a remaining portion of the non-transferred developer, which is not removed by the second cleaning member 180, is removed by the first cleaning member 170. For instance, the non-transferred developer may be removed by approximately 90% by the second cleaning member 180 and by approximately 10% by the first cleaning member 170. Accordingly, the second cleaning member 180 and the first cleaning members 170 may be referred as a main cleaning member and a subsidiary cleaning member, respectively.

A plurality of cleaning members 170 and 180 as described above may be required in an image forming apparatus using, for example, a spherical toner (a polymerized toner) of a small diameter. The spherical toner of a small diameter may be usable in a printing operation of the image forming apparatus to provide a superior printing quality. However, it may not be easy for only a single cleaning member to completely remove the remaining toner because a particle size thereof is very small.

As described above, by providing the plural cleaning members 170 and 180, the cleaning members and the image carrier may be prevented from being damaged. If only a single cleaning member is used for cleaning, since the cleaning member has to come in high pressure contact with the image carrier 110 to obtain a sufficient cleaning performance, the cleaning member and the image carrier 110 may be deformed at a contact portion thereof and the surface thereof, respectively. Such deformations may shorten a lifespan of the cleaning member and the image carrier and cause defects to a resultant image.

The first cleaning member 170 may include a first bracket 171 and a first cleaning blade 172.

The first bracket 171 may be made of a high strength metal material, such as a stainless steel. The first bracket 171 at one end thereof is fixed to an inner housing (not illustrated) of the developing unit 100, and at the other end thereof, has the first cleaning blade 172 attached thereto.

The first cleaning blade 172 comes in contact with the image carrier 110 to remove the non-transferred developer on the image carrier 110. For this, the first cleaning blade 172 at one end thereof is supported by or fixed to the first bracket 171, and at the other end thereof, is disposed to come in contact with the surface of the image carrier 110. The first cleaning blade 172 may be made of an elastic material. In the exemplary embodiment, the first cleaning blade 172 is made of a urethane material.

The second cleaning member 180 includes a second bracket 181 and a second cleaning blade 182.

The second bracket 181 may be made of a high strength metal material, such as an electrolytic galvanized iron (EGI) plate. The second bracket 181 at one end thereof is fixed to the inner housing (not illustrated) of the developing unit 100, and at the other end thereof has the second cleaning blade 182 attached thereto.

The second cleaning blade 182 comes in contact with the image carrier 110 to remove the non-transferred developer on the image carrier 110. The second cleaning blade 182 at one end thereof is supported by or fixed to the second bracket 181, and at the other end thereof, is disposed to come in contact with the surface of the image carrier 110. The second cleaning blade 182 is made of an elastic material, such as a urethane material, like the first cleaning blade 171.

In the exemplary embodiment, the second cleaning blade 182 is disposed in "a counter disposition" as a main cleaning blade. A distal end of the second cleaning clean blade 182 is bent from a main portion of the second cleaning blade 182 toward the counter disposition in a counter direction opposite to a rotation direction of the image carrier 110 with respect to a radial line connecting the main portion of the second cleaning blade 182 and a center of the image carrier 110 while the image carrier 110 works in the printing operation. In other words, the distal end of the second cleaning blade 182 is disposed in a counter clockwise direction opposite to the rotation direction (a clockwise direction) of the image carrier 110 in the printing operation. On the other hand, a cleaning blade may be disposed in a trailing disposition" or "a wiper disposition such that a distal end of the cleaning blade is bent from a main portion of the cleaning blade toward the training disposition in a clockwise direction corresponding to the rotation direction of the image carrier with respect to a radial line connecting the main portion of the cleaning blade and the center of the image carrier. The second cleaning blade 182 is configured not to have the trailing disposition, but the counter disposition as described above to provide a high cleaning performance for the second cleaning blade, which is the main cleaning blade.

According to an embodiment of the present general inventive concept, a blade of a bracket may be reversed (or moved) between two opposite positions (states) to each other with respect to a reference position of a surface of a roller, for example, an image carrier, Here, the reference position of a surface of a roller may be a position disposed on a line connecting a center of the roller and the bracket. It is possible that the reference position may be a position where different portions of the blade can contact the roller in the two opposite positions, respectively. The reference position may be disposed on a line connecting a portion of the blade attached to the bracket and a portion of the surface of the roller, for example, the image carrier.

However, the first cleaning blade 172 may be used as a secondary (or auxiliary) cleaning blade, and may not be fixed in any one of the counter disposition and the trailing disposition, but configured to be reversible (or movable) between the counter disposition and the trailing disposition.

Such a disposition reversion of the first cleaning blade 172 will be now described with reference to FIGS. 3A and 3B.

Figure 3A:
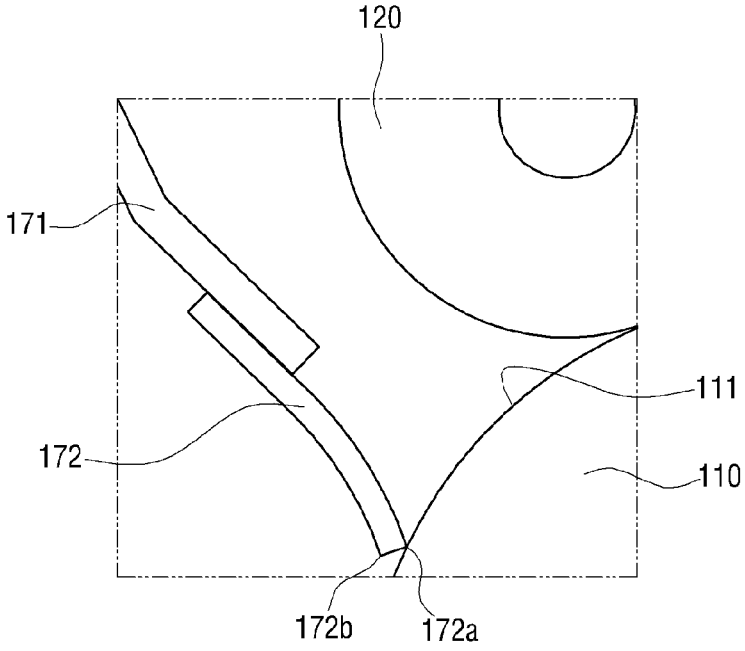
FIGS. 3A and 3B as views illustrating a disposition reversion of a first cleaning blade, and a state of the first cleaning blade in a counter disposition and a trailing disposition, respectively.
Figure 3B:
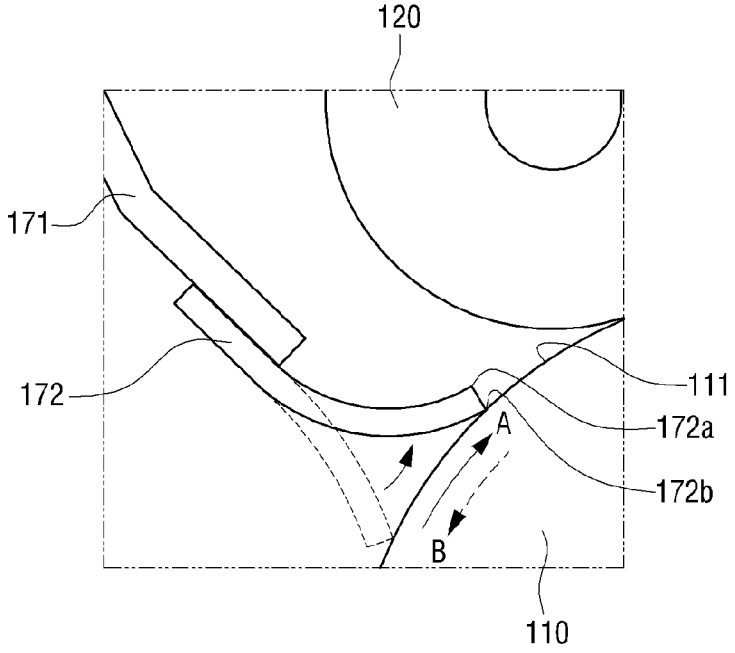

FIGS. 3A and 3B as views illustrating the disposition reversion of the first cleaning blade to move between two states where the first cleaning blade are in the counter disposition and the trailing disposition, respectively.

As illustrated in FIG. 3A, the first cleaning blade 172 is set to have the counter disposition. As explained above, the counter disposition is referred to as a disposition where the cleaning blade is disposed in a direction opposite to the rotation direction (A direction of FIG. 3B) of the image carrier 110 while the image carrier 110 is in a printing operation.

A free end of the first cleaning blade 172 has a first contact edge 172*a* and a second contact edge 172*b*, which are able to come in contact with the surface 111 of the image carrier 110. As illustrated in FIG. 3A, when the first cleaning blade 172 is disposed in the counter disposition, the first contact edge 172*a* comes in contact with the surface 111 of the image carrier 110.

As illustrated in FIG. 3B, when the image carrier 110 rotates in the A direction to perform a printing operation, the disposition of the first cleaning blade 172 is reversed (moved) from the counter disposition to the trailing disposition (or the wiper disposition). As explained above, the trailing disposition means a disposition where the cleaning blade is disposed in the rotation direction corresponding to A direction of the image carrier 110 while the image carrier 110 is in the printing operation. Since the first cleaning blade 172 is made of the urethane material having elasticity, the reversion of the first cleaning blade 172 may be conducted by a friction force applied thereto by the rotating image carrier 110.

As illustrated in FIG. 3B, when the first cleaning blade 172 is in the trailing disposition, the second contact edge 172*b* comes in contact with the surface 111 of the image carrier 110. Accordingly, when the non-transferred developer on the image carrier 110 is not substantially removed by the first contact edge 172*a*, the remaining non-transferred developer can be removed by the second contact edge 172*b*.

Like this, the first cleaning blade 172 may be set to have the counter disposition in a manufacturing process. However, the first cleaning blade 172 is reversed to the trailing disposition when the image carrier 110 rotates in the A direction for the printing operation (process). Accordingly, the second contact edge 172*b* of the first cleaning blade 172 may be maintained in a non-contact state where it does not come in contact with the image carrier 110 from the manufacturing process until the printing operation or a time to use the developing unit 100 and/or the image forming apparatus 1 to perform the printing operation to print an image on a printing medium. The second contact edge 172*b* is moved from the non-contact state to a contact state where it comes in contact with the image carrier 110 in the printing operation. The second contact edge 172*b* becomes in contact with the image carrier when the image forming apparatus 1 is turned on to perform a first printing operation to print an image on a printing medium.

Thus, even though duration from the point of fabrication time to the point of time beginning to be used is lasted long, the deformations of the second contact edge 172*b* caused by the contact pressure with the image carrier 110 may be minimized during a period between the manufacturing process and the printing operation. In a case of a longer non-used period of the image forming apparatus 1, a lifespan of the second contact edge 172*b* may not be shortened and a low performance is avoided, due to the deformations thereof.

On the other hand, as illustrated in FIG. 3B, the image carrier 110 may be configured to have a structure, which is rotated by an angle of given degrees (for example, one revolution or half a revolution) in a B direction when the printing operation is completed, before a new printing operation, or between printing operations, and in this case, the disposition of the first cleaning blade 172 may be reversed from the trailing disposition to the counter disposition.

When the disposition of the first cleaning blade 172 is reversed from the trailing disposition to the counter disposition, the developer piled-up on (or attached to) the second contact edge 172*b* of the first cleaning blade 172 may be removed. Accordingly, poor cleaning is prevented from being caused by the developer piled-up on the second contact edge 172*b*, and a cleaning performance is improved.

And, by reversing the disposition of the first cleaning blade 172 from the trailing disposition to the counter disposition when the printing operation is finished, the first cleaning blade 172 is maintained in the counter disposition until a next printing operation starts. Accordingly, until the image carrier 110 is set for the next printing operation, the second contact edge 172*b* of the first cleaning blade 172 may maintained in a non-contact state to the surface of the image carrier 110. Therefore, the deformations of the second contact edge 172*b* due to the contact pressure applied thereto by the image carrier 110 may be reduced, and as a result, a lifespan of the first cleaning blade 172 may be increased.

Referring again to FIG. 2, to improve the cleaning performance, the image forming apparatus 1 of the exemplary embodiment has two cleaning member 170 and 180. Also, the electricity removing member 160 emits the light through a space between the first cleaning member 170 and the charging member 120 toward the surface of the image carrier 110.

As illustrated in FIG. 2, if the image forming apparatus 1 is provided with the plurality of cleaning members 170 and 180, the space between the cleaning member 170 and the charging member 120 may be relatively reduced, as compared with the image forming apparatus with a single cleaning member. The space between the cleaning member 170 and the charging member 120 may be decreased when the image forming apparatus 1 is designed to be miniaturized. In this case, to maintain a good electricity removing performance, a method may be used to increase an intensity of light generated from the charging member 120, such as increasing the number of light sources (for example, LEDs). However, t this method of increasing the intensity of light for the charging member 120 may cause an increase in the manufacturing costs.

Figure 4:
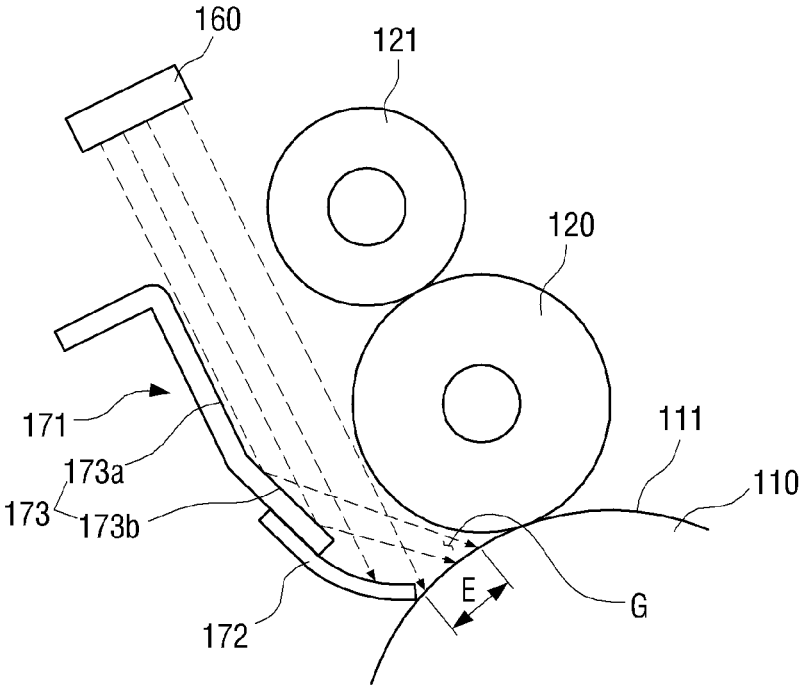
FIG. 4 is a view illustrating the first cleaning member and an electricity removing member to perform an electricity removing operation according to an embodiment of the present general inventive concept.

FIG. 4 is a view illustrating the cleaning blade to improve an electricity removing performance of the electricity removing member, according to an embodiment of the present general inventive concept.

Referring to FIG. 4, the electricity removing member 160 emits the light to the surface 111 of the image carrier 110 thus to remove a potential existing on the surface 111 of the image carrier 110. In a typical image forming apparatus, it is difficult for the light emitted from the electricity removing member 160 to reach a space G between a lower part of the charging member 120 and the surface of the image carrier 110.

The space G may be disposed between a contact point of the image carrier 110 and the charging member 120 and a line connecting a surface of the charging member 120 and the electricity removing member 160. The space G may be a region where the light emitted from the electricity removing member 160 cannot directly reach the surface of the image carrier 110 since the surface of the charging member 120 blocks a path of the light emitted from the electricity removing member 160 toward the image carrier 110.

In the exemplary embodiment, the first bracket 171 may include a reflection material (for example, silver, or nickel) at a side surface 173 thereof. For instance, the reflection material may be a reflection plate surface formed as the side surface of the first bracket 171, or may be formed as a separate reflection plate attached to the first bracket 171. The reflection plate may be made of the reflection material.

As the reflection material is provided on the side surface of the first bracket 171 as described above, the light emitted from the electricity removing member 160 is reflected by the side surface 173 of the first bracket 171, such that the reflected light can be incident to the space G on a lower side of the charging member 120. As illustrated in FIG. 4, the side surface 173 of the first bracket 171 is made up of two planes 173*a* and 173*b* inclined to each other, thereby allowing the first bracket 171 to enhance a light reflectance thereof.

It is possible that two planes 173*a* and 173*b* of the side surface 173 of the first bracket 171 can be used as a reflection surface to reflect the light toward the image carrier 110. It is also possible that any one of the two planes 173 and 173*b* of the side surface 173 of the first bracket 171 can be used as a reflection surface to reflect the light toward the image carrier 110.

Since the light of the electricity removing member 160 can reach the space G on the lower side of the charging member 120, a surface area of the image carrier 110 to receive the emitted light can be increased. In other words, a width E of an area on the surface of the image carrier 110 to receive the light emitted from the electricity removing member 160 can be increased. In an exemplary embodiment, the width E may be in a range from 0.65 mm to 4.56 mm according to a size of the image carrier.

As described above, by reflecting the light of the electricity removing member 160 through the side surface 173 of the first bracket 171, the electricity removing performance can be improved. Like this, since the electricity removing performance can be improved without increasing the number of the light sources, the manufacturing cost can be reduced.

According to a test where the electricity removing performance is measured when the silver or nickel was employed as the reflection material of the first bracket 171, test results were obtained as illustrated in table 1.

TABLE 1

| | Reflection material | | |
|---|---|---|---|
| | Not provided | Silver (Ag) | Nickel (Ni) |
| Potential after electricity removing | −150 V | −70 V | −30 V |

The first cleaning blade 172 used in the above test was made of a black color urethane material. And, the test for silver was carried out by using a beaten silver attached on the surface 173 of the first bracket 171, and the test for nickel was carried out by using the first bracket 171 on which a nickel plating is formed.

As stated in the above table 1, it showed that when there was no reflection material on the first bracket 171, the potential on the image carrier 110 after electricity removing was −150V. And, it showed that when the silver and the nickel were used as the reflection material on the first bracket 171, the potentials on the image carrier 110 after electricity removing were −70V and −30V, respectively.

From the foregoing, it could be confirmed that when the reflection material is provided on the first bracket 171, the electricity removing performance is improved, and also when the nickel is used as the reflection material, the electricity removing performance is more enhanced, as compared with the silver.

Although the present invention has been illustrated and explained by the exemplary embodiments, it is not limited to the foregoing exemplary embodiments. The present teaching can be readily applied to other types of apparatuses and many alternatives, modifications, and variations will be apparent to those skilled in the art. Thus, the scope of the present invention is not to be construed as being limited to the description of the exemplary embodiments, and is to be construed by the attached claims and equivalents.

What is claimed is:

1. A developing unit, comprising:

an image carrier on which an electrostatic latent image is formed;

a developing member to supply a developer to the image carrier;

a first cleaning blade to remove a non-transferred developer on the image carrier; and a second cleaning blade to remove the non-transferred developer on the image carrier, wherein the first cleaning blade is configured to be reversible between a counter disposition and a trailing disposition which are opposite to each other with respect to a reference surface of the image carrier, wherein the first cleaning blade is disposed in the trailing disposition during a printing operation, and the first cleaning blade is reversed from the trailing disposition to the counter disposition when the printing operation is finished, and wherein the second cleaning blade is disposed in the counter disposition.

2. The developing unit of claim 1, wherein the first cleaning blade is disposed in the counter disposition before a first printing operation of the developing unit, and is reversed to the trailing disposition in the first printing operation of the developing unit.

3. The developing unit of claim 1, wherein the reversion between the counter disposition and the trailing disposition is performed according to a friction force applied to the first cleaning blade from the image carrier when the image carrier rotates.

4. The developing unit of claim 1, wherein the first cleaning blade comprises a first contact edge to come in contact with the image carrier in the counter disposition and a second contact edge to come in contact with the image carrier in the trailing disposition.

5. The developing unit of claim 1, wherein the non-transferred developer on the image carrier is first removed by the second cleaning blade and is secondly removed by the first cleaning blade.

6. The developing unit of claim 1, wherein the first cleaning blade comprises an elastic material.

7. The developing unit of claim 6, wherein the first cleaning blade comprises a urethane material.

8. The developing unit of claim 1, wherein the developer comprises a polymerized toner having a minimized diameter.

9. The developing unit of claim 1, further comprising a first bracket to support the first cleaning blade with respect to the image carrier.

10. The developing unit of claim 9, further comprising:

a charging member to charge a surface of the image carrier with electricity; and an electricity removing member to emit a light to the image carrier thus to remove a potential on the surface of the image carrier, wherein the first bracket comprises a reflection material disposed at a side surface thereof to reflect at least a portion of the light emitted from the electricity removing member toward the surface of the image carrier.

11. The developing unit of claim 10, wherein the reflection material is plated on the side surface of the first bracket.

12. The developing unit of claim 10, wherein a reflection plate including the reflection material is attached to the side surface of the first bracket.

13. The developing unit of claim 10, wherein the reflection material comprises a nickel or silver.

14. The developing unit of claim 10, wherein the side surface of the first bracket comprises two planes inclined to each other.

15. A developing unit, comprising:

an image carrier on which an electrostatic latent image is formed;

a charging member to charge a surface of the image carrier with electricity;

a developing member to supply a developer to the image carrier;

a first cleaning blade to remove a non-transferred developer on the image carrier and a first bracket to support the first cleaning blade;

a second cleaning blade to remove the non-transferred developer on the image carrier and a second bracket to support the second cleaning blade; and an electricity removing member to emit a light to the image carrier to remove ana potential on the surface of the image carrier, wherein the first bracket comprises a reflection material disposed at a side surface thereof to reflect at least a portion of the light emitted from the electricity removing member toward the surface of the image carrier, wherein the first cleaning blade is disposed in the trailing disposition during a printing operation, and the first cleaning blade is reversed from the trailing disposition to the counter disposition when the printing operation is finished, and wherein the second cleaning blade is disposed in the counter disposition.

16. The developing unit of claim 15, wherein the electricity removing member emits the light through a space between the cleaning blade and the charging member toward the surface of the image carrier.

17. The developing unit of claim 15, wherein the side surface of the bracket comprises two planes inclined to each other.

18. An image forming apparatus having a developing unit, the developing unit comprising:

an image carrier on which an electrostatic latent image is formed;

a developing member to supply a developer to the image carrier; and a first cleaning blade to remove a non-transferred developer on the image carrier and a second cleaning member having a second cleaning blade to remove the non-transferred developer on the image carrier, wherein the first cleaning blade is configured to be reversible between a counter disposition, and a trailing disposition disposed opposite to the counter disposition with respect to a reference surface of the image carrier in a printing operation, wherein the first cleaning blade is disposed in the trailing disposition during a printing operation, and the first cleaning blade is reversed from the trailing disposition to the counter disposition when the printing operation is finished, and wherein the second cleaning blade is disposed in the counter disposition.

* * * * *